United States Patent [19]

Cohn

[11] 4,055,295

[45] Oct. 25, 1977

[54] SELF-SEALING ENVELOPE AND METHOD OF MAKING SAME

[75] Inventor: Robert Cohn, Millbrae, Calif.

[73] Assignee: Champion International Corporation, Stamford, Conn.

[21] Appl. No.: 723,236

[22] Filed: Sept. 15, 1976

[51] Int. Cl.[2] ..... B65D 27/14

[52] U.S. Cl. ..... 229/80; 34/1; 156/273; 219/10.81

[58] Field of Search ..... 156/273, 441.5; 229/80; 219/10.81; 34/1

[56] References Cited

U.S. PATENT DOCUMENTS

| | | | |
|---|---|---|---|
| 2,087,410 | 7/1937 | Lane et al. | 229/80 |
| 2,147,689 | 2/1939 | Chaffee | 34/1 |
| 2,606,856 | 8/1952 | Hurrey et al. | 156/273 |
| 2,676,416 | 4/1954 | Calosi et al. | 34/1 |
| 2,723,517 | 11/1955 | Mittelmann | 219/10.81 |
| 3,293,765 | 12/1966 | Winkler et al. | 34/1 |
| 3,357,108 | 12/1967 | Bennett | 34/1 |
| 3,396,474 | 8/1968 | Walther et al. | 34/1 |
| 3,404,462 | 10/1968 | Hanson et al. | 34/1 |
| 3,456,355 | 7/1969 | Cumming et al. | 34/1 |

*Primary Examiner*—Stephen P. Garbe
*Attorney, Agent, or Firm*—Evelyn M. Sommer

[57] ABSTRACT

A self-sealing envelope is made by folding a paper blank having a flap, a front panel, a back panel and end flaps. Back seams of the body are sealed with an adhesive having a predetermined dielectric constant. Strips of latex material having the same or a lesser dielectric constant are applied to the flap and body in positions which register when the flap is closed. The envelope is dried in a dielectric heating chamber. Suitable latex materials have a low pH factor or a low metal salt content.

4 Claims, 3 Drawing Figures

SELF-SEALING ENVELOPE AND METHOD OF MAKING SAME

BACKGROUND OF THE INVENTION

The present invention relates to envelopes and more particularly to self-sealing envelopes and a mehtod for making the same.

A self-sealing envelope generally includes strips of latex material applied both to the flap of the envelope and to the body of the envelope. When the flap is closed, the flap strip bears against the body strip. Neither latex strip need be moistened in order to form a seal between the two.

The manufacture of self-sealing envelopes of the type described has not been free of problems. To reduce drying time for seam adhesive and latex and thus increase production rates, envelope manufacturers often use dielectric ovens or heating chambers. Dielectric heating chambers include two or more spaced electrodes connected to a high frequency oscillator. The oscillator output is generally in the range of 2,000 – 20,000 volts at frequencies ranging from 2 Megahertz to 90 Megahertz. The alternating electric fields established between the electrodes cause molecular agitation (i.e., heating) in the material to be dried. As a result, moisture is driven from the material in the form of vapor.

Where such dielectric heating chambers have been employed in the drying of self-sealing envelopes, a high electric field is necessary to dry the latex material. However, it has been found that the electric field intensity is greatest in those areas containing seam adhesive. The high electric field intensity and resulting concentration of generated heat can, and has, caused the envelope paper to become discolored, scorched and even burned along the seam. The same discoloration, scorching or burning has been found where an envelope window has been applied with a conventional adhesive.

Also, where latex material is applied over a previously-dried back seam, the dielectric drying of the latex material can still cause the latex to blister and discolor. It is believed that moisture in the latex adhesive penetrates the paper and enters the back seam adhesive.

The incidences of discoloration, etc. can be reduced by either reducing the operating voltage or the operating frequency of the high frequency oscillator for the dielectric heating chamber. However, since the drying effect of a dielectric heating chamber is equal to the product of the frequency and the square of the voltage, reducing either obviously reduces the efficiency of the chamber.

As an alternative a spark detector has been used in combination with the dielectric heating chamber. Whenever arcing is detected, the detector shuts down the high frequency oscillator. Intermittent operation of the high frequency oscillator naturally lowers the rate of production of the envelopes.

SUMMARY OF THE INVENTION

The present invention is a self-sealing envelope and a method for manufacturing the same in which dielectric drying at high operating voltages and high operating frequencies may be employed without discoloring, scorching or burning envelopes. The envelope is manufactured by folding and sealing a body for an envelope using an adhesive having a predetermined conductivity. The first strip of latex material is applied to the body of the envelope and a second strip of latex material is applied to an attached flap in a position wherein the second strip registers with the first strip when the flap is closed. The latex material has a dielectric constant approximately the same or less than the dielectric constant of the adhesive used in sealing the envelope body. The envelope is then dried in a dielectric heating chamber.

DESCRIPTION OF THE DRAWINGS

While the specification concludes with claims particularly pointing out and distinctly claiming that which is regarded as the present invention, details of preferred embodiments of the invention may be more readily ascertained from the following detailed description when read in conjunction with the accompanying drawings wherein:

DETAILED DESCRIPTION

Figure 1:
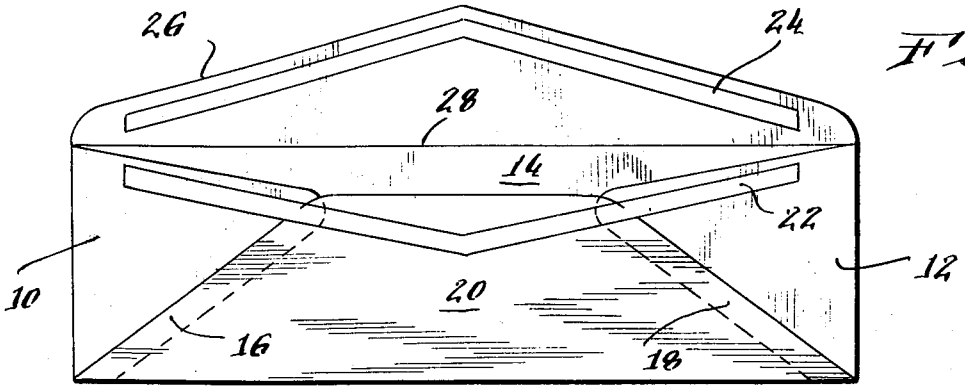
FIG. 1 shows the back of an open envelope manufactured in accordance with the present invention.

Referring now to FIG. 1, a conventional business envelope is illustrated. Such an envelope is manufactured from a paper blank by folding generally triangular end flaps 10 and 12 inwardly against a rectangular front panel 14 of the envelope. Adhesive is then applied to surface areas 16 and 18 of the end flaps 10 and 12, respectively. A back panel 20 is folded upwardly against the end flaps 10 and 12. Back panel 20 is sealed to the end flaps 10 and 12 by the adhesive in areas 16 and 18 wherein the end flaps 10 and 12 and the back panel 20 overlap one another.

A first strip 22 of latex material is applied to the body of the envelope. A second strip 24 of the same latex material is applied to an attached flap 26. The latex strips 22 and 24 are equidistant from a score line 28 at the juncture of flap 26 and front panel 14. When flap 26 is closed, the first and second latex strips 22 and 24 are brought into registration or contact with one another. The latex material in the two strips 22 and 24 adhere to secure the flap 26 in a closed position. No wetting of either latex strip is required.

The practice of the invention is not limited to the particular envelope configuration illustrated in FIG. 1. Any envelope manufactured with adhesives and latex may employ the present invention without regard to configuration.

Figure 2:
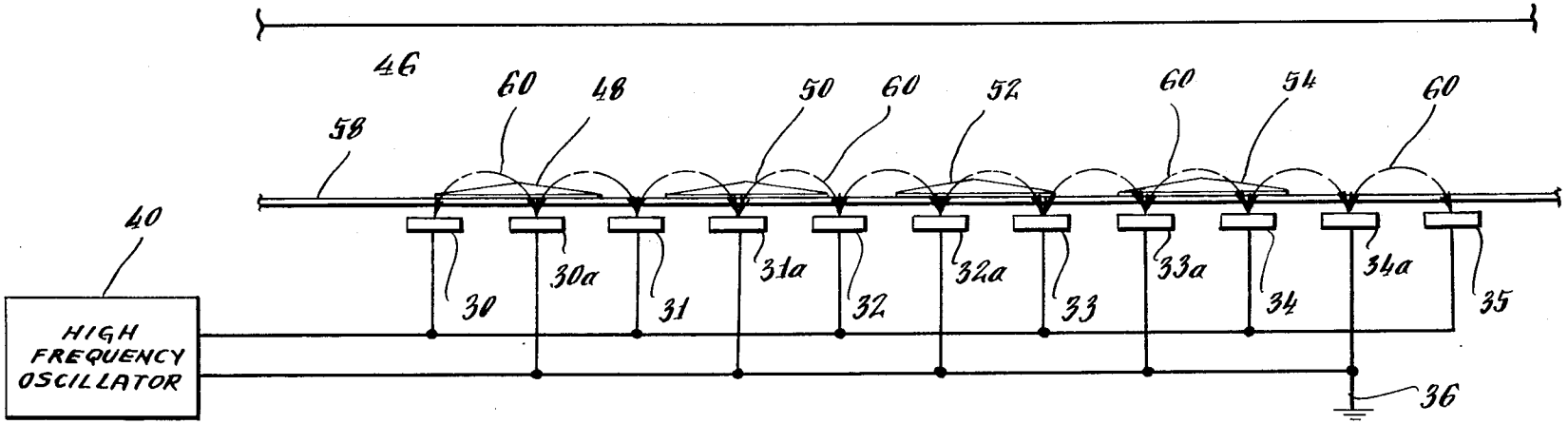
FIG. 2 is a simplified schematic diagram of a dielectric heating chamber for drying envelopes manufactured in accordance with the invention.

The envelope is dried in a dielectric heating chamber of the type shown in greatly simplified form in FIG. 2. A series of electrodes 30-35 are connected to a high frequency oscillator 40. Alternate terminals, such as terminals **30*a*–34*a* are connected to a ground terminal 36. As mentioned earlier, high frequency oscillator 40 may produce voltages in the range of 2,000 to 12,000 volts across the terminals at operating frequencies of 2 Megahertz to 90 Megahertz. The high frequency voltage at the terminals sets up high frequency electric fields within a dielectric tunnel 46**.

A number of envelopes 48, 50, 52, 54 and 56 are shown being transported through the tunnel 46 on a conveyor 58. Electric flux lines 60 bridge adjacent terminals. For one half cycle of oscillator output, the flux emanates in the indicated directions. For the opposite half cycle, the flux direction is reversed. Some of the flux lines extend far enough into tunnel 46 to intercept the envelopes carried on conveyor 58. Internal molecular agitation produced by the intercepting flux heats the adhesive applied in the areas 16 and 18 of each envelope and the latex material applied in strips 22 and 24. The internal heating of the adhesive and latex causes moisture to be driven from the materials.

The dielectric heating chamber may be a conventional apparatus, such as is available from Reeves Electronics, 609 West Lake Street, Chicago, Ill.

Figure 3:
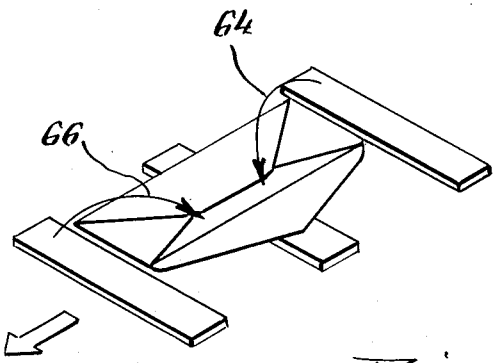
Fig. 3. PRIOR ART
FIG. 3 is a simplified perspective showing an electric field between adjacent electrodes in the dielectric heating chamber of FIG. 2 for a prior art envelope.

Referring to FIG. 3, where the adhesive is more conductive than the latex material, the electric flux linking adjacent terminals in the dielectric heating chamber tends to be channeled along the adhesive areas; i.e., along strips 16 and 18 since these strips form the path of least resistance for dielectric current in the electric field. For example, notice current paths 64 and 66.

To avoid concentration of the electric field in areas 16 and 18 with consequent discoloration, scorching or burning, the adhesive is selected from commercially-available adhesives which are approximately as conductive or less conductive than the latex material. Expressed slightly differently, the dielectric constant of the selected adhesive must be greater than or approximately equal to the dielectric constant of the selected latex material. Suitable adhesives may either have a low pH value or a low metal salt content.

One suitable adhesive is manufactured and sold by National Starch Company of San Francisco, Calif., under the designation National #32-3327 Back Seam Gum. Suitable latex materials are also available commercially. For example, Fuller-Paisley Co. of San Francisco, Calif., manufactures and sells a suitable latex material which is designated as #47-2436-0.

Referring to FIG. 1, where the latex material in the strips 22 and 24 is about as conductive or more conductive than the adhesive used to seal the back seams of the envelope, differential heating in the areas 16 and 18 can be reduced. The intersections 61 and 62 of latex strip 22 and areas 16 and 18, respectively, are particularly critical areas. The paper-adhesive-paper-latex "sandwich" in each of the areas 61 and 62 generally contains more moisture than other areas of the envelope.

By selecting an adhesive having approximately the same or a smaller dielectric constant than the selected latex material, unacceptable heating with consequent discoloration, scorching and/or burning in the areas 61 and 62 cannot be avoided without reducing either the operating voltage or the operating frequency of the high frequency oscillator in the dielectric heating chamber.

The preceding description indicates the dielectric constant of the adhesive must be approximately the same as or greater than the dielectric constant of the latex material. However, an adhesive dielectric constant many times higher than the latex dielectric constant has been found to be satisfactory at operating voltages up to 10,000 volts and operating frequencies in the range of 25 to 30 Megahertz.

While there has been described what is considered to be a preferred embodiment of the invention, variations and modifications thereof may occur to those skilled in the art once they become familiar with the basic concepts of the invention. Therefore, it is intended that the appended claims shall be construed to include all such variations and modifications as fall within the true spirit and scope of the invention.

What is claimed is:

1. A method of making self-sealing envelopes from paper blanks including the steps of:

folding and sealing a body for the envelope using an adhesive having a predetermined dielectric constant, and allowing said adhesive to at least partially dry;

subsequently, applying a first strip of moist latex material to the body of the envelope and a second strip of moist latex material to an attached flap in a position in which the second strip registers with the first strip when the flap is folded against the body of the envelope, the latex material having a dielectric constant approximately the same or less than the dielectric constant of the adhesive; and drying the envelope in a dielectric heating chamber.

2. A self-sealing envelope made by:

folding a paper blank to form an envelope having a body and a flap;

sealing seams in the body using an adhesive having a predetermined dielectric constant;

applying a first strip of moist latex material to the body of the envelope and a second strip of moist latex material to the flap of the envelope in a position in which the second strip registers with the first strip when the flap is folded against the body, the latex material having a dielectric constant approximately the same as or less than the dielectric constant of the adhesive; and drying the envelope in a dielectric heating chamber.

3. A self-sealing envelope comprising:

a paper blank folded and sealed to form an envelope having a flap and a body portion with seams secured by an adhesive having a predetermined dielectric constant;

a first strip of latex material on the body of the envelope; and a second strip of latex material on the flap of the envelope in a position in which the second strip registers with the first strip when the flap is folded against the body of the envelope, said first strip and said second strip of latex material having a dielectric constant on the order of or less than the dielectric constant of the adhesive.

4. A method of making self-sealing envelopes including the steps of:

applying a first strip of latex material to the body of an envelope having seams sealed with adhesive of a predetermined dielectric constant;

applying a second strip of latex material to an attached flap of said envelope in a position in which the second strip registers with the first strip when the flap is folded against the body of the envelope, the latex material used in said first and second strips having a dielectric constant approximately the same as or less than the dielectric constant of the adhesive.

* * * * *